US005750912A

United States Patent [19]

Matsumoto

[11] Patent Number: 5,750,912

[45] Date of Patent: May 12, 1998

[54] FORMANT CONVERTING APPARATUS MODIFYING SINGING VOICE TO EMULATE MODEL VOICE

[75] Inventor: Shuichi Matsumoto, Hamamatsu, Japan

[73] Assignee: Yamaha Corporation, Hamamatsu, Japan

[21] Appl. No.: 784,815

[22] Filed: Jan. 16, 1997

[30] Foreign Application Priority Data

Jan. 18, 1996 [JP] Japan ..... 8-6850

[51] Int. Cl.[6] ..... A63H 5/00

[52] U.S. Cl. ..... 84/609; 434/307 A; 395/2.18; 395/2.7

[58] Field of Search ..... 84/600, 609, 610, 84/634, 636; 395/2.18, 2.7, 2.76; 434/307 A

[56] References Cited

U.S. PATENT DOCUMENTS 4,882,758 11/1989 Uekawa et al. .
5,477,003 12/1995 Muraki et al. ..... 434/307 A
5,525,062 6/1996 Ogawa et al. ..... 434/307 A
5,536,902 7/1996 Serra et al. ..... 84/623
5,567,901 10/1996 Gibson et al. ..... 84/605 X

*Primary Examiner*—William M. Shoop, Jr.
*Assistant Examiner*—Jeffrey W. Donels
*Attorney, Agent, or Firm*—Pillsbury Madison & Sutro LLP

[57] ABSTRACT

In a voice modifying apparatus for modifying a singing voice to emulate a model voice, a microphone collects the singing voice created by a singer. An analyzer sequentially analyzes the collected singing voice to extract therefrom actual formant data representing resonance characteristics of a singer's own vocal organ which is physically activated to create the singing voice. A sequencer operates in synchronization with progression of the singing voice for sequentially providing reference formant data which indicates a vocal quality of the model voice and which is arranged to match with the progression of the singing voice. A comparator sequentially compares the actual formant data and the reference formant data with each other to detect a difference therebetween during the progression of the singing voice. An equalizer modifies frequency characteristics of the collected singing voice according to the detected difference so as to emulate the vocal quality of the model voice.

20 Claims, 12 Drawing Sheets

FORMANT CONVERTING APPARATUS MODIFYING SINGING VOICE TO EMULATE MODEL VOICE

BACKGROUND OF THE INVENTION

1. Field of the Invention

The present invention relates to a formant converting apparatus suitable for converting voice quality of a singing voice, and to a karaoke apparatus using such a formant converting apparatus.

2. Description of the Related Art

In karaoke apparatuses, lyrics of a karaoke song appear on a monitor to prompt a vocal performance as the song progresses. A singer follows the displayed lyrics to sing the karaoke song. The karaoke apparatus allows many singers to enjoy singing together. However, in order to sing songs with a skill higher than a certain level, some training may be required. One of the training methods of singing is so-called voice training. In the voice training, abdominal breathing is mainly practiced, which, when mastered, enables a singer to sing without stage fright for example. One's singing skill depends on not only the articulation of utterance of the lyrics and how one stays in tune throughout singing, but also one's voice quality such as thick voice and thin voice. The voice quality largely depends on a contour of one's vocal organ. Therefore, the voice training has its limitation in having trainees acquire the skill of uttering good singing voices.

Meanwhile, with regard to artificial voice signal converting apparatuses, a so-called harmonic karaoke apparatus and a special voice processor apparatus have been developed. In the harmonic karaoke apparatus, a voice signal inputted from a microphone is frequency-converted to generate another voice signal corresponding to a high-tone or low-tone part. In the voice processor apparatus, a formant of an input voice signal is shifted evenly along a frequency axis to alter the voice quality. The formant denotes resonance characteristics of the vocal organ when a vowel is uttered. This resonance characteristics correspond to each individual's voice quality.

The above-mentioned harmonic karaoke apparatus merely performs the frequency conversion on the voice signal to shift a key. Therefore, the karaoke machines of this type can only alter the pitch of karaoke singer's voice. They cannot alter the voice quality itself.

On the other hand, the above-mentioned voice processor apparatus shifts the singer's formant evenly or uniformly along the frequency axis. However, the formant of a singing voice dynamically varies on realtime, so that application of this apparatus to the karaoke machine to alter the quality of the singing voice hardly improves pleasantness to the ear.

SUMMARY OF THE INVENTION

It is therefore an object of the present invention to provide a formant converting or modifying apparatus and a karaoke apparatus using the same for dynamically altering the formant of a singing voice to modify the quality thereof for better karaoke performance.

According to the invention, a voice modifying apparatus for modifying a singing voice to emulate a model voice comprises an input section that collects the singing voice created by a singer, an analyzing section that sequentially analyzes the collected singing voice to extract therefrom actual formant data representing resonance characteristics of a singer's own vocal organ which is physically activated to create the singing voices a sequencer section that operates in synchronization with progression of the singing voice for sequentially providing reference formant data which indicates a vocal quality of the model voice and which is arranged to match with the progression of the singing voice, a comparing section that sequentially compares the actual formant data and the reference formant data with each other to detect a difference therebetween during the progression of the singing voice, and a modifying section that modifies frequency characteristics of the collected singing voice according to the detected difference so as to emulate the vocal quality of the model voice.

In one form, the sequencer section comprises a memory that stores a time-sequential pattern of the reference formant data provisionally sampled from a model singing sound of the model voice, and a sequencer that retrieves the time-sequential pattern of the reference formant data from the memory in synchronization with the progression of the singing voice.

In another form, the sequencer section comprises a memory that stores a set of formant data elements provisionally sampled from vowel components of the model voice, and a sequencer that sequentially retrieves the formant data elements in correspondence to vowel components contained in the singing voice so as to form the reference formant data in synchronization with the progression of the singing voice. Preferably, the memory further stores lyric or word data which indicates a sequence of phonemes to be voiced by the singer to produce the singing voice and sequence data which indicates timings at which each of the phonemes is to be voiced. The sequencer analyzes the word data and the sequence data to identify each of the vowel components contained in the singing voice so that the sequencer can retrieve the formant data element corresponding to the identified vowel component.

In a further form, the sequencer section comprises a memory that provisionally records a model singing sound of the model voice, and a sequencer that sequentially processes the recorded model singing sound to extract therefrom the reference formant data.

In a specific form, the analyzing section includes an envelope generator that provides the actual formant data in the form of a first envelope of a frequency spectrum of the singing voice. The sequencer section includes another envelope generator that provides the reference formant data in the form of a second envelope of a frequency spectrum of the model voice. The comparing section includes a comparator that differentially processing the first envelope and the second envelope with each other to detect an envelope difference therebetween. The modifying section comprises an equalizer that modifies the frequency characteristics of the collected singing voice based on the detected envelope difference so as to equalize the frequency characteristics of the collected singing voice to those of the model voice.

According to the invention, a karaoke apparatus for producing a karaoke music to accompany a singing voice while modifying the singing voice to emulate a model voice comprises a tone generating section that generates the karaoke music according to karaoke data, an input section that collects the singing voice created by a karaoke player along with the karaoke music, an analyzing section that sequentially analyzes the collected singing voice to extract therefrom actual formant data representing resonance characteristics of a karaoke player's own vocal organ which is physically activated to create the singing voice, a sequencer section that operates in synchronization with progression of the karaoke music for sequentially providing reference formant data which indicates a vocal quality of the model voice and which is arranged according to the karaoke data in matching with the progression of the singing voice, a comparing section that sequentially compares the actual formant data and the reference formant data with each other to detect a difference therebetween, a modifying section that modifies frequency characteristics of the collected singing voice according to the detected difference so as to emulate the vocal quality of the model voice, and a mixer section that mixes the modified singing voice to the generated karaoke music in real time basis.

In a specific form, the sequencer section comprises a memory that stores a set of formant data elements provisionally sampled from vowel components of the model voice, and a sequencer that sequentially retrieves the formant data elements in correspondence to vowel components contained in the singing voice so as to form the reference formant data in synchronization with the progression of the karaoke music. Preferably, the memory further stores the karaoke data containing lyric word data which indicates a sequence of phonemes to be voiced by the karaoke player to create the singing voice and containing sequence data which indicates timings at which each of the phonemes is to be voiced. The sequencer analyzes the lyric word data and the sequence data to identify each of the vowel components contained in the singing voice so that the sequencer can retrieve the formant data element corresponding to the identified vowel component.

In a typical form, the karaoke apparatus further comprises a requesting section that requests a desired one of the karaoke music which is originally sung by a professional singer so that the sequencer section provides the reference formant data which indicates a specific vocal quality of the model voice of the professional singer.

DETAILED DESCRIPTION OF PREFERRED EMBODIMENTS

This invention will be described in detail by way of example with reference to the accompanying drawings.

Figure 1:
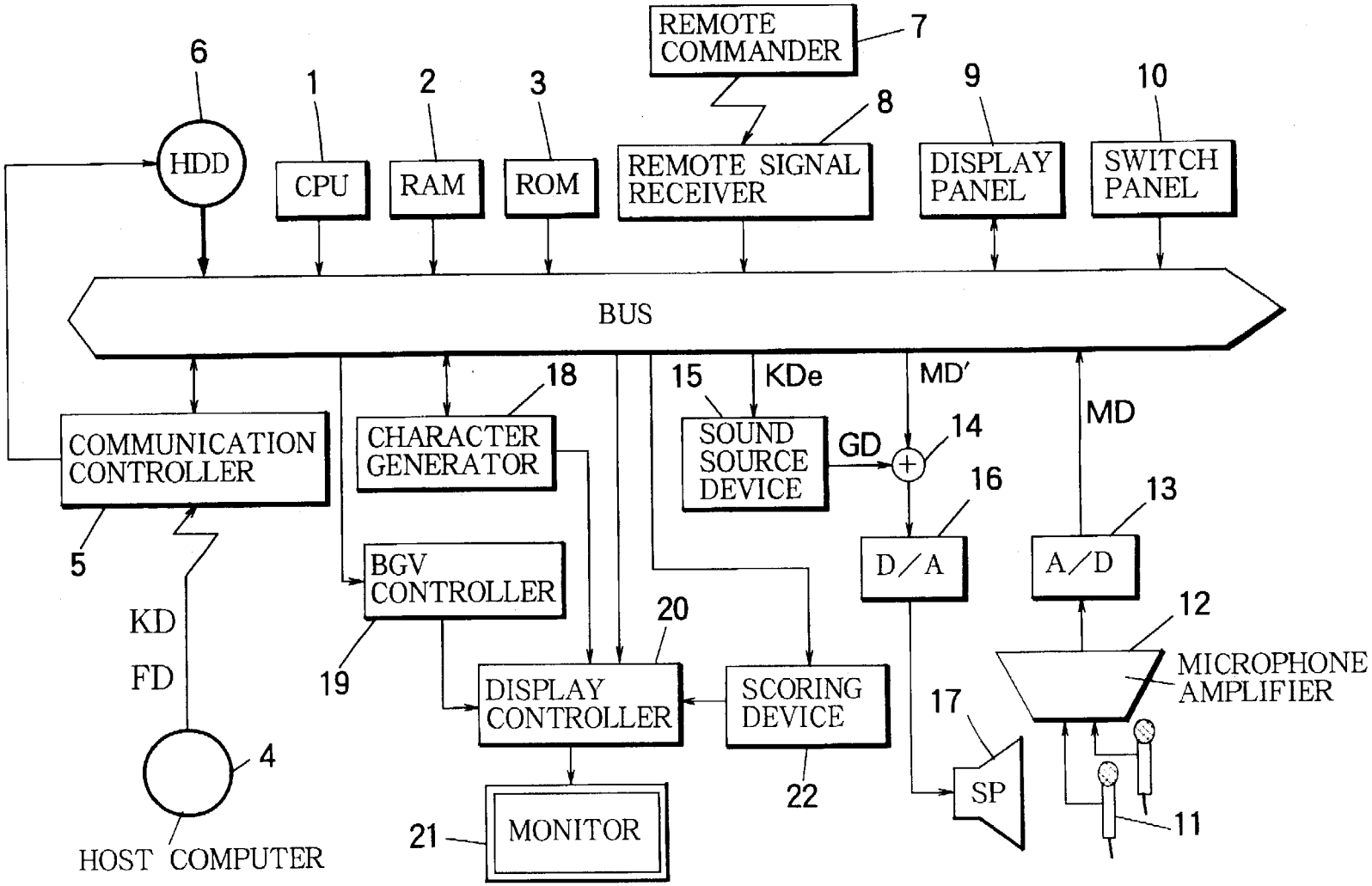
FIG. 1 is a block diagram illustrating a karaoke apparatus practiced as a first preferred embodiment of the present invention.
Figure 2:
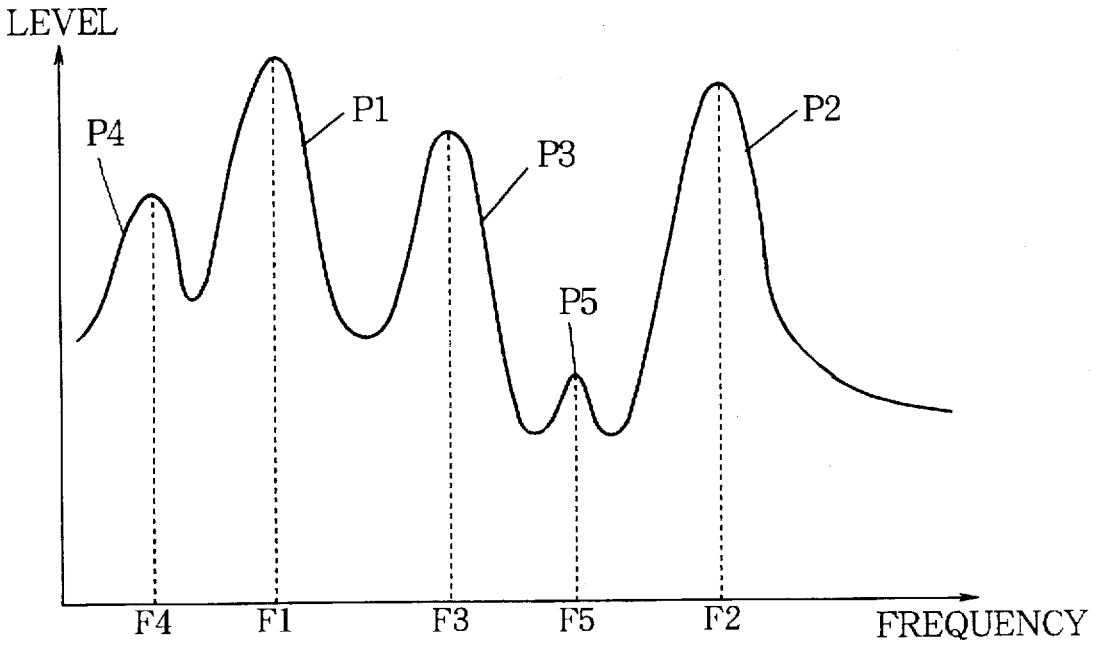
FIG. 2 is a graph illustrating a concept of formant.

Now, referring to FIG. 1, the block diagram illustrates a karaoke apparatus practiced as the first preferred embodiment of the present invention.

In the figure, reference numeral 1 indicates a CPU (Central Processing Unit) connected to other components of the karaoke apparatus via a bus to control these components. Reference numeral 2 indicates a RAM (Random Access Memory) serving as a work area for the CPU 1, temporarily storing various data required. Reference numeral 3 indicates a ROM (Read Only Memory) for storing a program executed for controlling the karaoke apparatus in its entirety, and for storing information of various character fonts for displaying lyrics of a requested karaoke song.

Reference numeral 4 indicates a host computer connected to the karaoke apparatus via a communication line. From the host computer 4, karaoke music data KD are distributed in units of a predetermined number of music pieces along with formant data FD for use in altering voice quality of a karaoke singer or player. The music data KD are composed of play data or accompaniment data KDe for playing a musical sound, lyrics data KDk for displaying the lyrics, wipe sequence data KDw for indicating a sequential change in color tone of characters of the displayed lyrics, and image data KDg indicating a background image or scene. The play data KDe are composed of a plurality of data strings called tracks corresponding to various musical parts such as melody, bass, and rhythm. The format of the play data KDe is based on so-called MIDI (Musical Instrument Digital Interface).

The following describes the formant data FD with reference to FIGS. 2 through 7. First, an example of formant will be described with reference to FIG. 2. Shown in the figure is an envelope of a typical frequency spectrum of a vowel. The frequency spectrum has five peaks P1 through P5, which correspond to formants. Generally, the peak frequency at each peak is referred to as a formant frequency, while the peak level at each peak is referred to as a formant level. In the following description, the respective formant peaks are called as a first formant, a second formant and so on in the decreasing order of the peak level.

Figure 3:
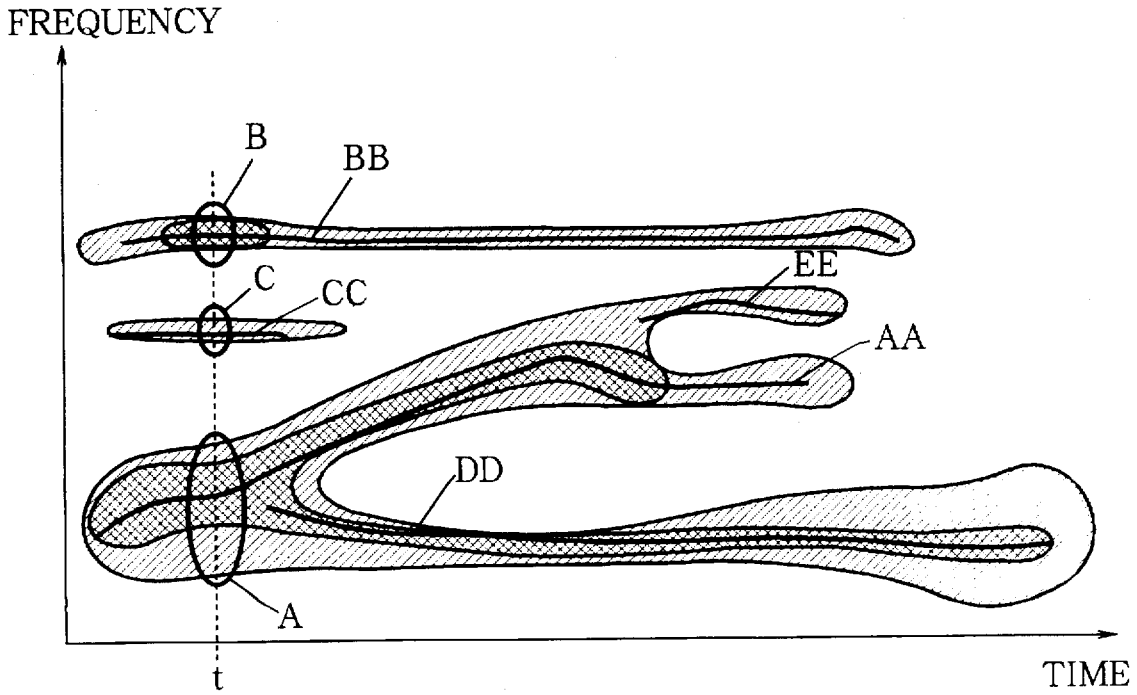
FIG. 3 is a graph illustrating a sonogram of a singing voice.

Meanwhile, a sonogram is known as means for analyzing a voice in terms of a time axis. The sonogram is graphically represented by the time axis in lateral direction and a frequency axis in vertical direction with the magnitude of voice levels visualized in shades of gray. FIG. 3 shows a typical sonogram of a singing voice. In the figure, dark portions indicate that the voice level is high. Each of these portions corresponds to each formant. For example, at time t, formants exist in portions A, B, and C. Referring to FIG. 3, lines AA through EE indicate time-variation of peak frequencies at the respective formants.

Figure 4:
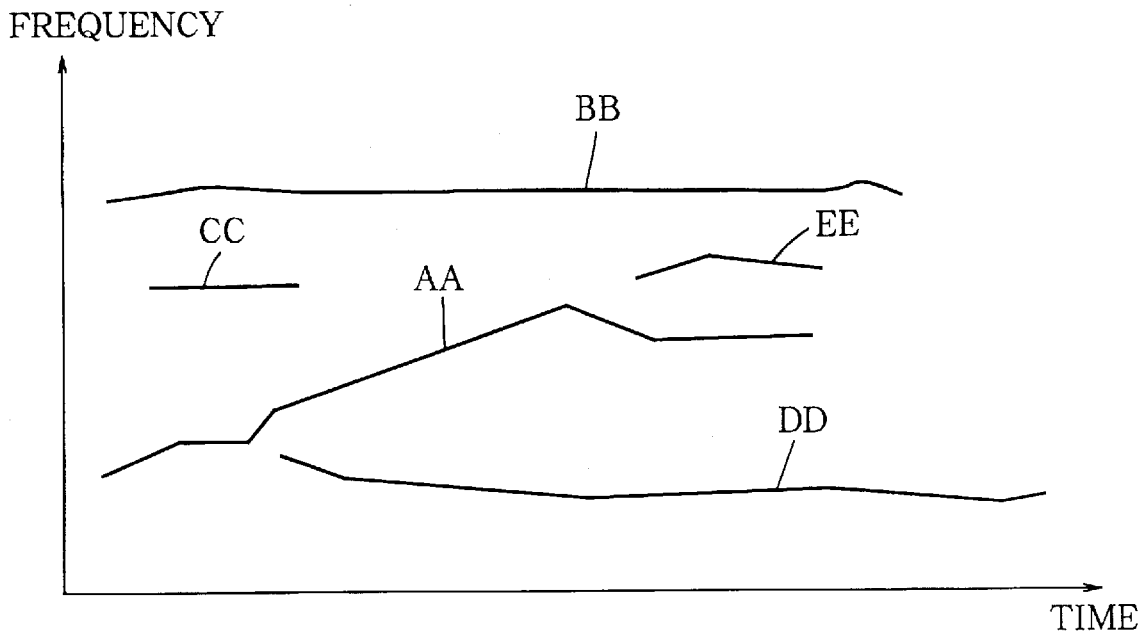
FIG. 4 is a graph illustrating formants extracted from the sonogram of FIG.

FIG. 4 illustrates extractions of the formant lines AA–EE from FIG. 3. In FIG. 4, the line BB shows relatively small change as time elapses, while the line AA changes significantly with time. This indicates that the formant frequency associated with the line AA changes significantly with time.

Figure 5:
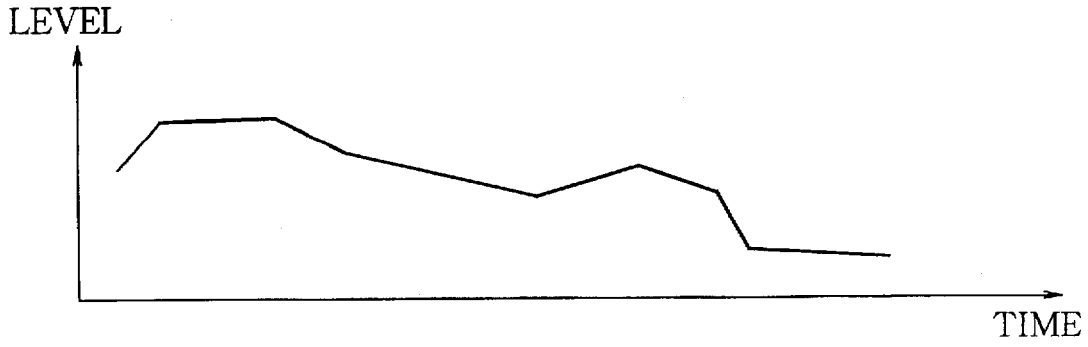
FIG. 5 is a graph illustrating a time-variation in a formant level.

Referring to FIG. 5, there is shown an example of time-dependent changes of the formant level indicated by the line AA of FIG. 4. As shown, the formant level changes with time to a large extent. This indicates that the formant frequency and the formant level of a singing voice fluctuate dynamically during the course of the vocal performance.

Turning to the Japanese language, each consonant is followed by a vowel in general. Since a, consonant is a short, transient sound, one's voice quality is dependent mainly on the utterance of vowels. On the other hand, the formant is representative of the resonance frequency of the vocal organ which is physically activated by the singer when a vowel is uttered. Therefore, modification of the formant of the singing voice can alter the voice quality. To achieve this effect, the present embodiment prepares reference formant data that indicate reference formants used to adjust or modify the frequency characteristic of the singing voice such that the formants of the singing voice are matched with the reference formants.

Figure 6:
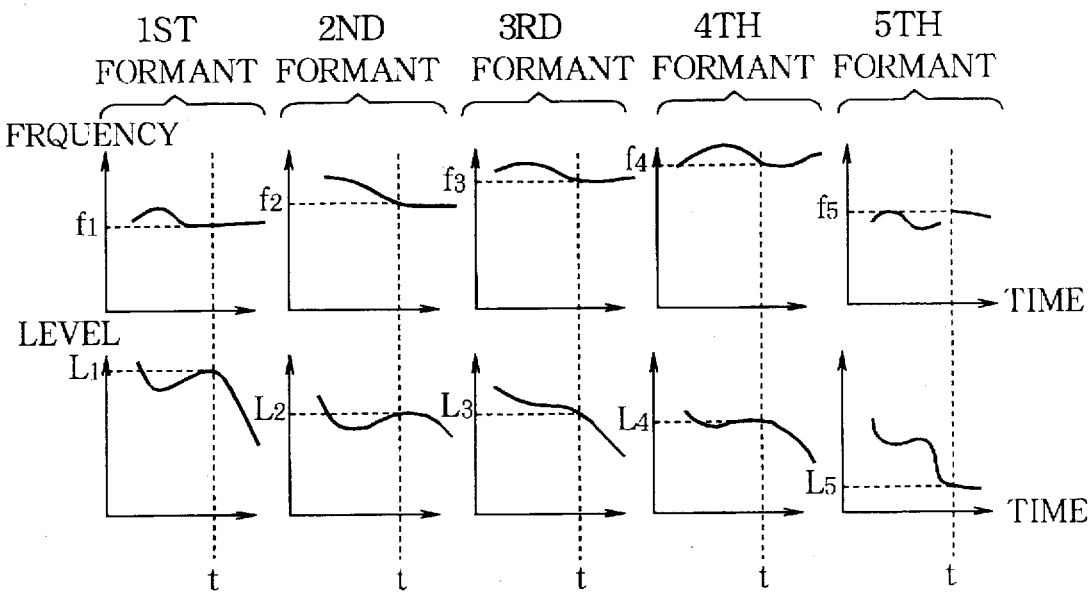
FIG. 6 is a diagram illustrating patterns of formant data.

The reference formant data FD is provided as reference at the time when the formant conversion processing is performed on a singing voice. The formant data FD are composed of pairs of a formant frequency and a formant level. The formant data FD in this example are constituted to correspond to the first through fifth formants, respectively. FIG. 6 shows an example of the formant frequencies indicated by the formant data FD and the corresponding formant levels. In the figure, the upper portion indicates time-dependent formant frequency changes, while the lower portion indicates time-dependent formant level changes. In this example, the formant data FD at time t contain "(f1, Lf), (f2, L2), (f3, L3), (f4, L4), and (f5, L5)."

Figure 7:
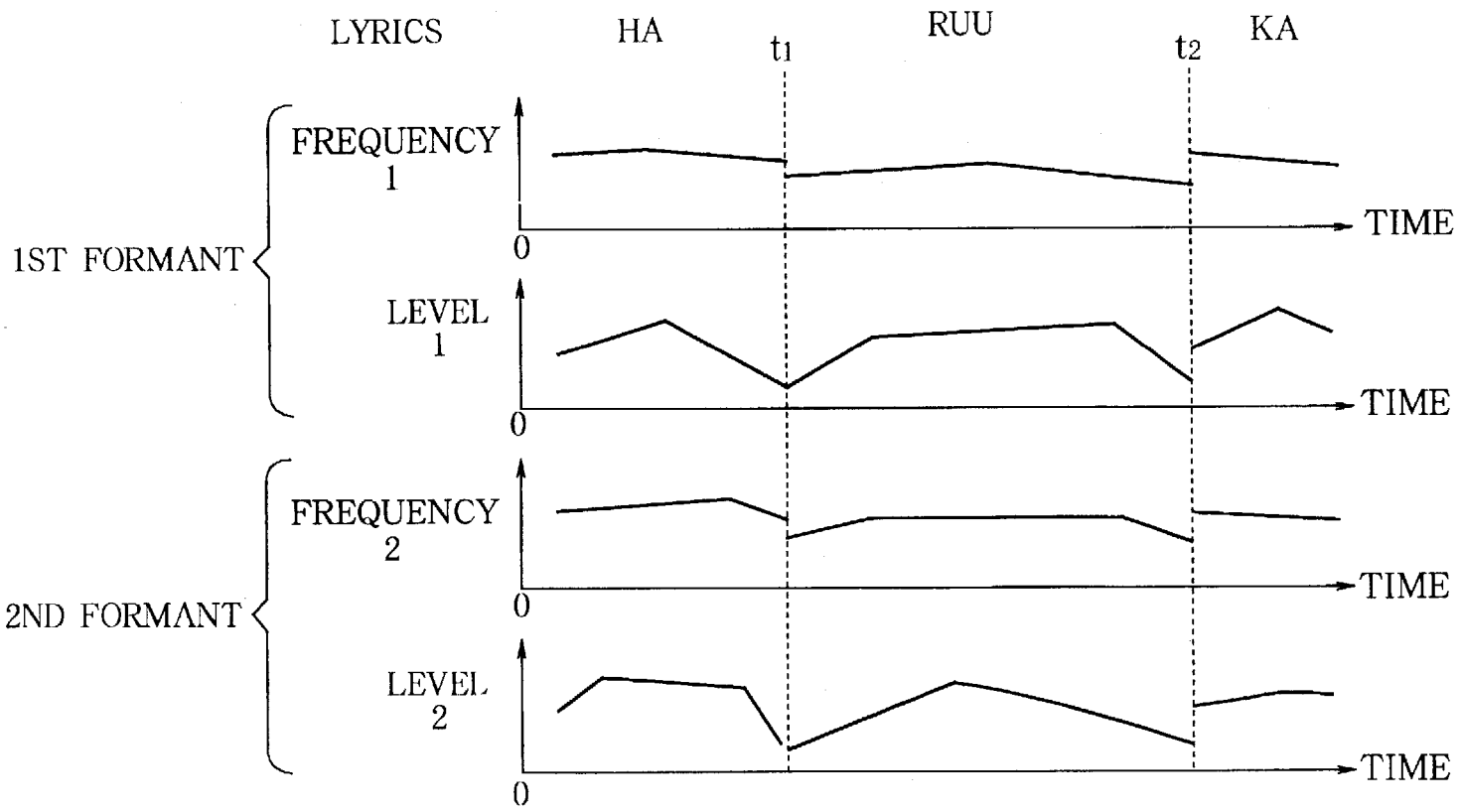
FIG. 7 is diagram illustrating a relationship between progression of lyrics and time-variation of formant data.

The following describes a relationship between the progression of the lyrics utterance and the sequence of the formant data FD with reference to FIG. 7. In the figure, only the formant data FD associated with the first and second formants are illustrated. The remaining formant data FD associated with the third through fifth formants are not shown just for simplicity. In this example, an utterance train of the lyrics go on as "HA RUU KA" as shown. The formant frequencies indicated by the formant data FD are discontinuous between time t1 and time t2. This is because the lyrics change from "A" to "RUU" at time t1 and from "RUU" to "KA" at time t2, involving the vowel change in the utterance of the lyrics. On the other hand, no vowel change occurs during an interval between time t0 and time t1 corresponding to "HA" and during an interval between time t1 and time t2 corresponding to "RUU", involving no significant change in the formant frequencies. On the contrary, the formant levels change to a considerable extent even during the utterance interval of each vowel because the formant levels are influenced by accent and intonation. Thus, the formant data FD indicate formant states that change with time.

Referring to FIG. 1 again, reference numeral 5 indicates a communication controller composed of a modem and other necessary components to control data communication with the host computer 4. Reference numeral 6 indicates a hard disk (HDD) that is connected to the communication controller 5 and that stores the karaoke music data KD and the formant data FD. Reference numeral 7 indicates a remote commander connected to the karaoke apparatus by means of infrared radiation or other means. When the user enters a music code, a key, and a desired model voice quality, for example, by using the remote commander 7, the same detects these inputs to generate a detection signal. Upon receiving the detection signal transmitted from the remote commander 7, a remote signal receiver 8 transfers the received detection signal to the CPU 1. Reference numeral 9 indicates a display panel disposed on the front side of the karaoke apparatus. The selected music code and the selected type of the model voice quality are indicated on the display panel 9. Reference numeral 10 indicates a switch panel disposed on the same side as the display panel 9. The switch panel 10 has generally the same input functions as those of the remote commander 7. Reference numeral 11 indicates a microphone through which a singing voice is collected and converted into an electrical voice signal. Reference numeral 15 indicates a sound source device composed of a plurality of tone generators to generate music tone data GD based on the play data KDe contained in the music data KD. One tone generator generates tone data GD corresponding to one tone or timbre based on the play data KDe corresponding to one track.

Then, the voice signal inputted from the microphone 11 is amplified by a microphone amplifier 12, and is converted by an A/D converter 13 into a digital signal, which is output as voice data MD. When the user selects modification of the voice quality by the remote commander 7, formant conversion processing is performed on the voice data MD, which is then fed to an adder or mixer 14 as adjusted or modified voice data MD'. The adder 14 adds or mixes the music tone data GD and the adjusted voice data MD' together. The resultant composite data are converted by a D/A converter 16 into an analog signal, which is then amplified by an amplifier (not shown). The amplified signal is fed to a speaker (SP) 17 to acoustically reproduce the karaoke music and the singing voice.

Reference numeral 18 indicates a character generator. Under control of the CPU 1, the character generator 18 reads font information from the ROM 3 in accordance with lyrics word data KDk read from the hard disk 6 and performs wipe control for sequentially changing colors of the displayed characters of the lyrics in synchronization with the progression of a karaoke music based on wipe sequence data KDw. Reference numeral 19 indicates a BGV controller, which contains an image recording media such as a laser disk for example. The BGV controller 19 reads image information corresponding to a requested music specified by the user for reproduction from the image recording media based on image designation data KDg to transfer the read image information to a display controller 20. The display controller 20 synthesizes the image information fed from the BGV controller 19 and the font information fed from the character generator 18 with each other to display the synthesized result on a monitor 21. A scoring or grading device 22 scores or grades the singing performance, the result of which is displayed on the monitor 21 through the display controller 20. The grading device 22 is fed with differential envelope data EDd indicating a difference between the actual formant extracted from the voice data MD and the reference formant of the model voice. The grading device 22 accumulates the differential envelope data throughout one song to score the singing performance.

Figure 8:
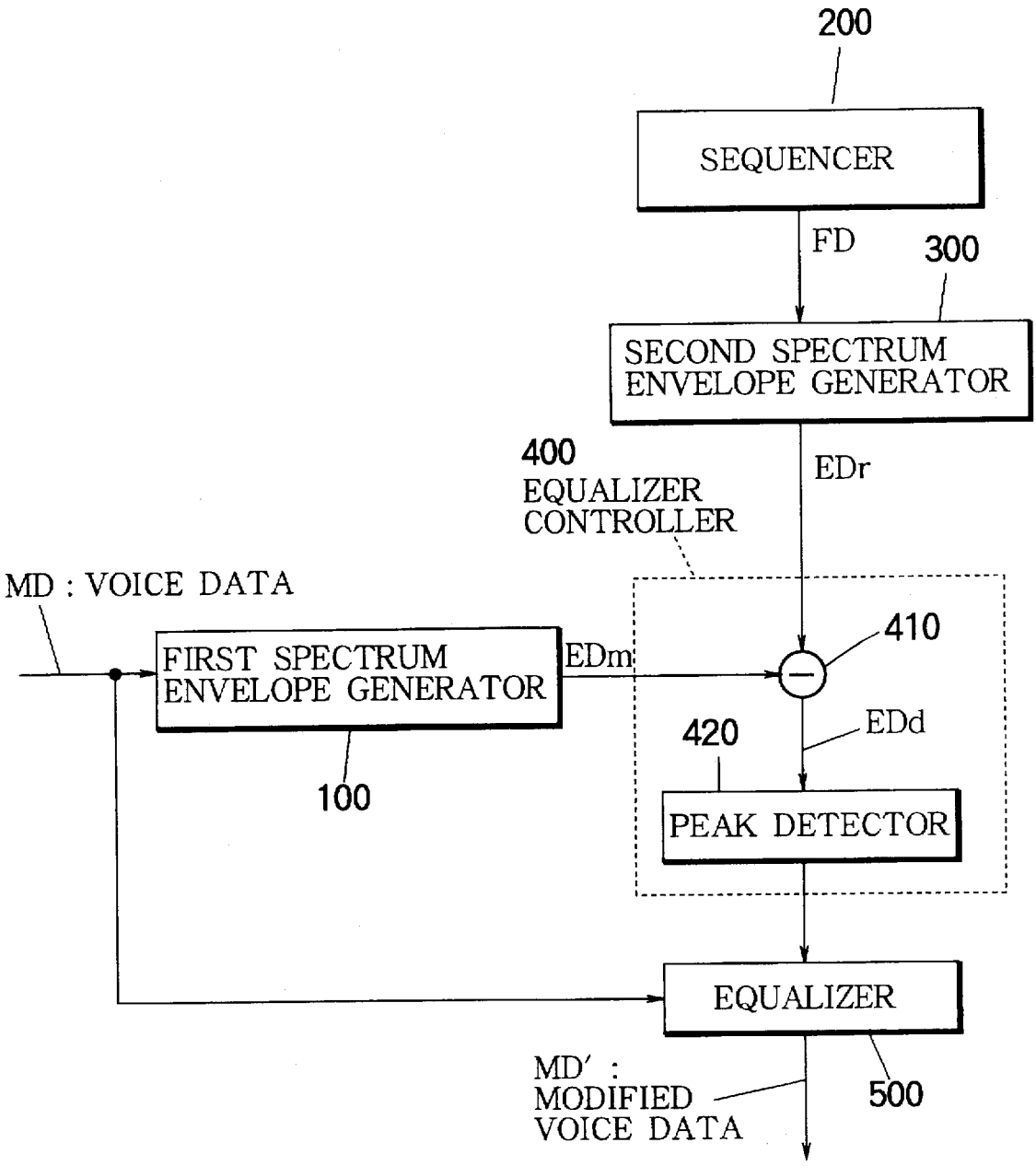
FIG. 8 is a diagram illustrating functional blocks of a CPU associated with the first preferred embodiment of the present invention.
Figure 9:
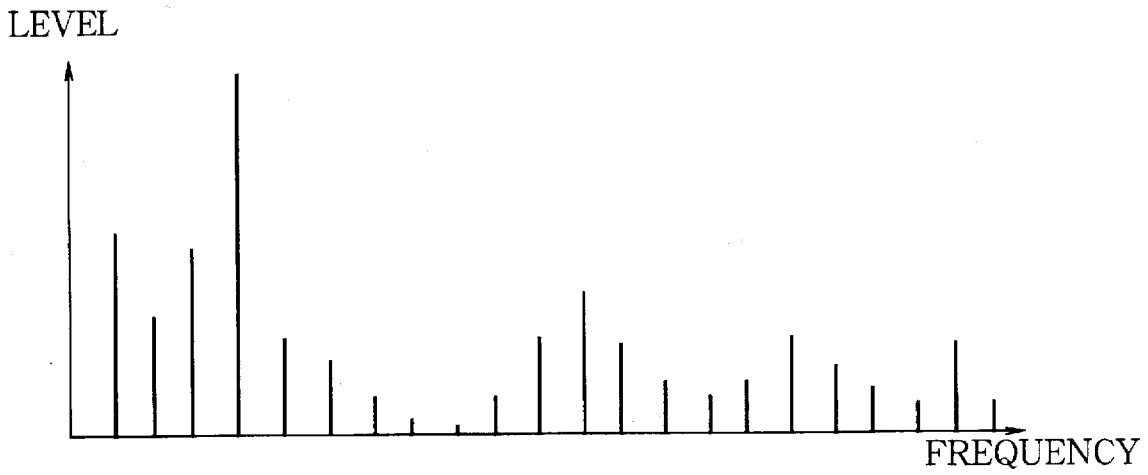
FIG. 9 is a graph illustrating a frequency spectrum of a singing voice treated by the first preferred embodiment of the present invention.
Figure 10:
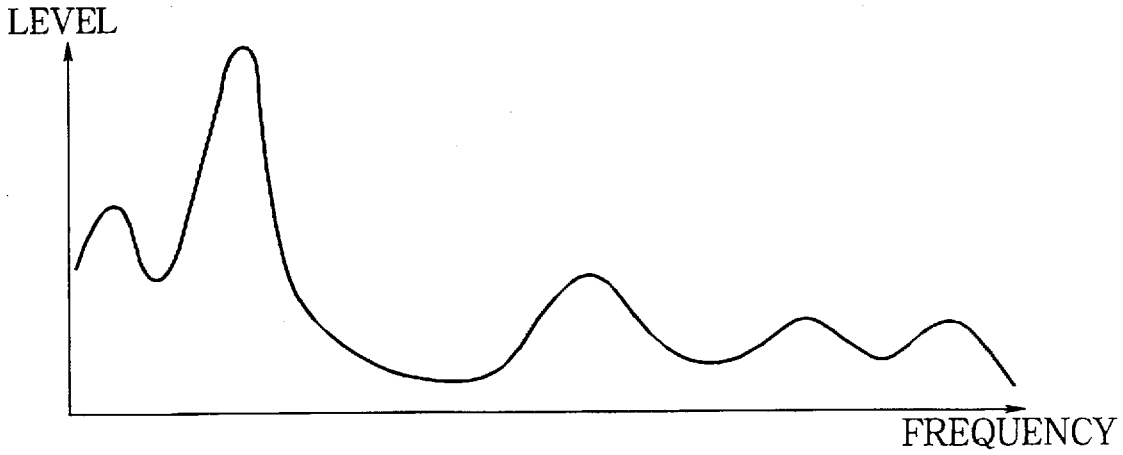
FIG. 10 is a graph illustrating an example of singing voice envelope data treated by the first preferred embodiment of the present invention.

The following describes the functional constitution of the CPU 1 associated with the formant conversion processing. FIG. 8 shows the functional blocks of the CPU 1. As shown, the CPU 1 is configured to perform various functions assigned to the respective blocks. In the figure, reference numeral 100 indicates a first spectrum envelope generator in which spectrum analysis is performed on the singing voice represented by the voice data MD to generate voice envelope data EDm that indicates the envelope of the frequency spectrum of the singing voice. For example, if the frequency spectrum of the singing voice is detected as shown in FIG. 9, then an envelope indicated by the voice envelope data EDm is generated as shown in FIG. 10.

Reference numeral 200 in FIG. 8 indicates a sequencer that sequentially processes music data KD and the formant data FD. From the sequencer 200, the formant data FD are output as the karaoke music progresses. Reference numeral 300 indicates a second spectrum envelope generator for generating, from the reference formant data FD, reference envelope data EDr of the frequency spectrum associated with the model voice. As described above, the formant data FD are composed of pairs of the formant frequency and the formant level, so that the second spectrum envelope generator 300 approximates these data to synthesize or generate the reference envelope data EDr. For this approximation, the least squares method is used for example.

Reference numeral 400 indicates an equalizer controller composed of a subtractor 410 and a peak detector 420 to generate equalizer control data. First, the subtractor 410 subtracts the voice envelope data EDm from the reference envelope data EDr to generate the differential envelope data EDd. Then, the peak detector 420 calculates peak frequencies and peak levels of the differential envelope data EDd to output the calculated values as the equalizer control data.

Figure 11A:
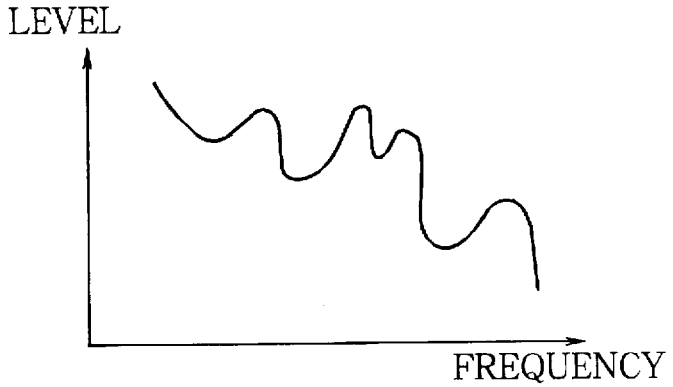
FIG. 11A is a graph illustrating an operation of an equalizer controller of FIG. 8.
Figure 11B:
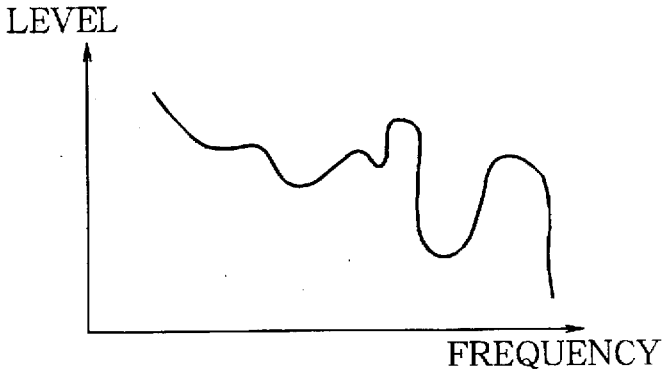
FIG. 11B is a graph illustrating another operation of the equalizer controller.
Figure 11C:
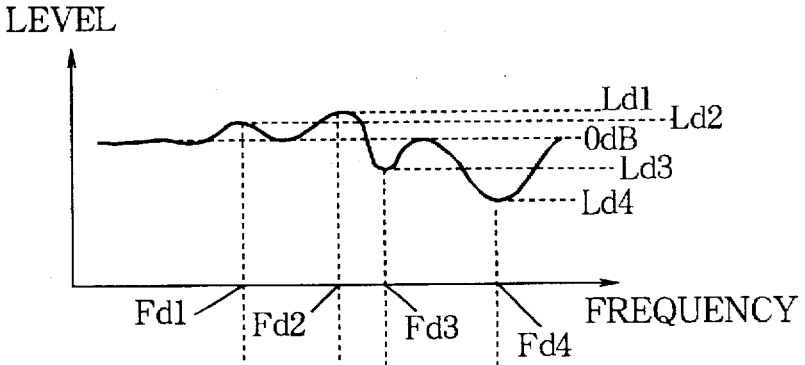
FIG. 11C is a graph illustrating still another operation of the equalizer controller.

For example, an envelope indicated by the reference envelope data EDr is depicted in FIG. 11A and another envelope indicated by the voice envelope data EDm is depicted in FIG. 11B. Then, a differential envelope indicated by the differential envelope data EDd is calculated as shown in FIG. 11C. In this case, the peak detector 420 detects peak frequencies Fd1, Fd2, Fd3, and Fd4 and peak levels Ld1, Ld2, Ld3, and Ld4 corresponding to four peaks contained in the differential envelope of FIG. 11C. The detected results are outputted as the equalizer control data.

Figure 11D:
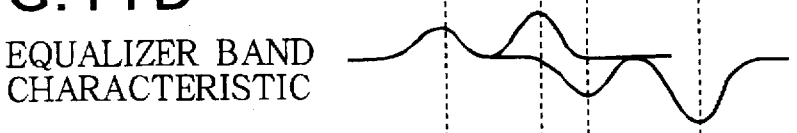
FIG. 11D is a graph illustrating a bandpass characteristic of an equalizer of FIG. 8.
Figure 11E:
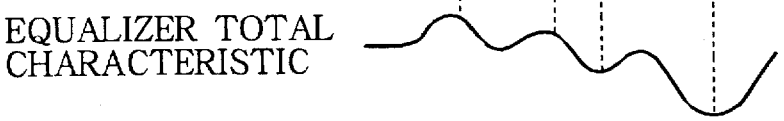
FIG. 11E is a graph illustrating a total frequency response of the equalizer.

Reference numeral 500 in FIG. 8 indicates an equalizer composed of a plurality of bandpass filters. These bandpass filters have adjustable center frequencies and adjustable gains thereof. The passband frequency response of the filters is controlled by the equalizer control data. For example, if the equalizer control data indicate the peak frequencies Fd1 through Fd4 and the peak levels Ld1 through Ld4 as shown in FIG. 11C, then the bandpass filters constituting the equalizer 500 are tuned to have individual frequency characteristics as shown in FIG. 11D, resulting in a total frequency characteristic of the equalizer 500 as shown in FIG. 11E.

The following describes overall operation of the first preferred embodiment of the invention with reference to drawings. Now, referring to FIG. 1, when the user operates the remote commander 7 or the switch panel 10 to specify the music code of a desired music, the CPU 1 detects the specified code and accesses the hard disk 6 to transfer therefrom the music data KD and the formant data FD corresponding to the specified code to the RAM 2. At the same time, the CPU 1 controls the display controller 20 to display the specified music code and a corresponding music title, and to display a prompt for formant conversion on the monitor 21.

Figure 12:
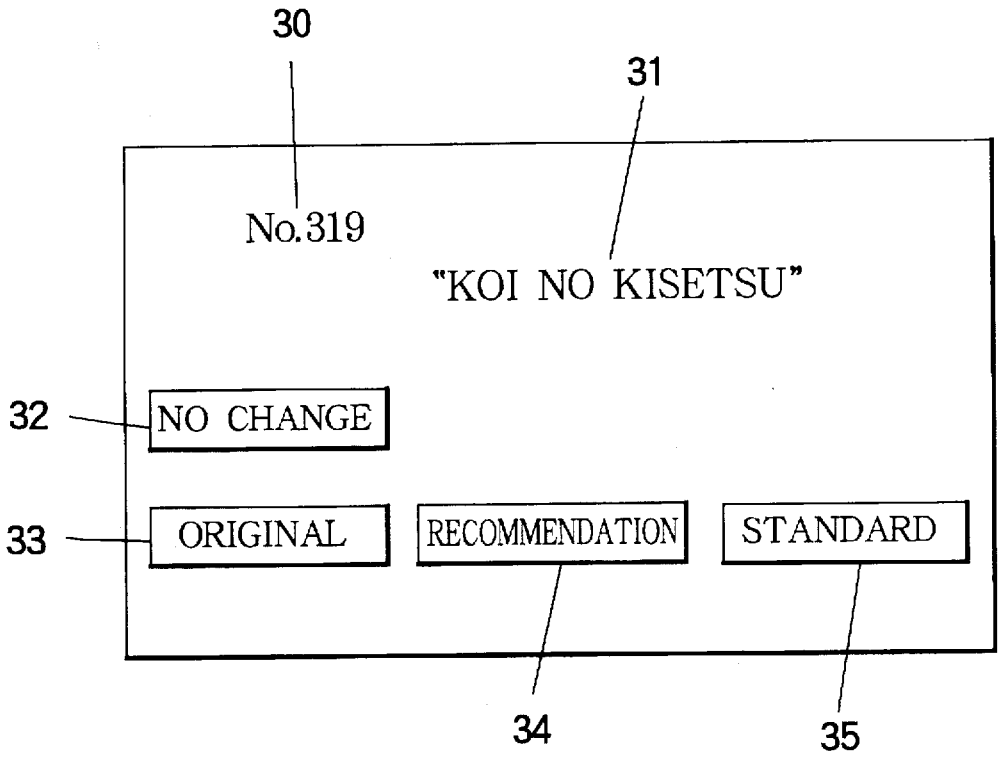
FIG. 12 is a diagram illustrating an initial monitor screen displaying a requested piece of music.

For example, if the specified music code is "319" and the title of the music is "KOI NO KISETSU," the initial menu screen is displayed as shown in FIG. 12, in which "319" and "KOI NO KISETSU" are indicated in label areas 30 and 31, respectively. The initial screen also contains label areas 32 through 35, which can be selected by means of the remote commander 7. Operating a select button on the remote commander 7, these label areas flash sequentially so as to enable the user to select a type or mode of the formant conversion processing. When the formant conversion is selected, the CPU 1 detects the selected mode to transfer corresponding formant data FD from the hard disk 6 to the RAM 2.

In this example, if "ORIGINAL" written in the label area 33 is selected, the formant data FD corresponding to the model voice of an original professional singer of the requested music are transferred to the RAM 2. If "RECOMMENDATION" menu in the label area 34 is selected, the formant data FD corresponding to a model voice that matches mood or atmosphere of the specified music are called and transferred to the RAM 2. If "STANDARD" menu of the label area 35 is selected, the formant data FD corresponding to a model voice sampled by singing the specified music in a typical vocalism generally considered as an optimum manner are transferred to the RAM 2. If "NO CHANGE" menu of the label area 32 is selected, no formant conversion processing is performed.

Then, upon start of the lyrics display based on the lyrics data KDk and the background image display based on the image data KDg on the monitor 21, the karaoke singer sings while following the lyrics being displayed on the monitor. A voice signal output from the microphone 11 is converted by the A/D converter 13 into the voice data MD. Then, the voice data MD are treated under control of the CPU 1 for the formant conversion processing based on the selected formant data FD. The resultant modified voice data MD' are fed to the adder 14. The adder 14 adds or mixes the music tone data GD and the modified or adjusted voice data MD' together. The resultant mixed data are converted by the D/A converter 16 into an analog signal, which is amplified by an amplifier (not shown) and fed to the speaker 17 for sounding.

The following describes operations of the formant conversion processing with reference to FIG. 8. When the voice data MD are fed to the first spectrum envelope generator 100, the same detects a frequency spectrum of the voice data MD and generates the voice envelope data EDm indicating the envelope of the detected frequency spectrum. The peak of the envelope associated with the voice envelope data EDm indicates the formant of the singing voice uttered by the karaoke singer.

In the above-mentioned initial screen of FIG. 12, if the menu area 33 labeled "ORIGINAL" is selected, the sequencer 200 of FIG. 8 reads the formant data FD corresponding to the original singer from the hard disk 6 to transfer the read formant data to the RAM 2. When the karaoke play starts, the sequencer 200 sequentially reads the formant data FD from the RAM 2 as the karaoke music progresses and supplies the read formant data to the second spectrum envelope generator 300. Based on the formant frequency and the formant level indicated by the formant data FD, the second spectrum envelope generator 300 generates the reference envelope data EDr that indicates the envelope of the frequency spectrum of the model singing voice. In this case, the formant data FD is provisionally sampled and extracted from the model voice of the original singer, so that 21 the peak of the envelope represented by the reference envelope data EDr indicates the formant of the model voice uttered by the original singer.

Then, when the voice envelope data EDm and the reference envelope data EDr are fed to the equalizer controller 400, the subtractor 410 calculates a difference between these envelope data EDm and EDr, which is denoted as the difference envelope data EDd. The difference envelope data EDd indicate the difference in formant between the model singing voice of the original singer that provides the reference and the actual singing voice uttered by the karaoke singer. When the difference envelope data EDd are fed to the peak detector 420, the same generates based on the fed data EDd equalizer control data that indicate the peak frequency and peak level of the formant difference.

When the equalizer control data are fed to the equalizer 500, the equalizing characteristic thereof is adjusted based on the fed control data. The frequency characteristic of the equalizer 500 is set so that the formant of the singing voice uttered by the karaoke singer emulates the formant of the model singing voice of the original singer. Next, when the original voice data MD are fed to the equalizer 500, the same modifies the frequency characteristic of the voice data MD to generate the adjusted voice data MD'. The formant of the adjusted voice data MD' approximates the formant of the model voice of the original singer. Thus, when acoustically reproducing the singing voice based on the adjusted voice data MD', the voice quality of the karaoke singer can well emulate the voice quality of the original singer.

As described, the first preferred embodiment prepares the formant data FD that indicate the formants of the model voice to which the formant of the singing voice of the karaoke singer is compared. Based on the comparison result, the frequency characteristic of the voice data MD inputted from the microphone 11 is adjusted by the equalizer 500. Consequently, the formant of the singing voice of the karaoke singer can be altered, resulting in a modified voice quality that could not be attained by physical voice training. For example, the present embodiment enables a karaoke singer whose voice is thin to reproduce from the speaker a thick voice suitable for singing a song that is more pleasant to the ear with more enjoyment of karaoke performance.

The inventive karaoke apparatus shown in FIG. 1 produces a karaoke music to accompany a singing voice while modifying the singing voice to emulate a model voice. In the apparatus, a tone generating section in the form of the sound source device 15 generates the karaoke music according to karaoke play data KDe. An input section including the microphone 11 collects the singing voice created by a karaoke player along with the karaoke music. An analyzing section formed in the CPU 1 sequentially analyzes the collected singing voice to extract therefrom actual formant data representing resonance characteristics of a karaoke player's own vocal organ which is physically activated to create the singing voice. A sequencer section also formed in the CPU 1 operates in synchronization with progression of the karaoke music for sequentially providing reference formant data which indicates a vocal quality of the model voice and which is arranged according to the karaoke data KDe in matching with the progression of the singing voice. A comparing section formed also in the CPU 1 sequentially compares the actual formant data and the reference formant data with each other to detect a difference therebetween. A modifying section configured in the CPU 1 modifies frequency characteristics of the collected singing voice according to the detected difference so as to emulate the vocal quality of the model voice. A mixer section including the adder 14 mixes the modified singing voice to the generated karaoke music in real time basis.

In detail, as shown in FIG. 8, the analyzing section includes the first envelope generator 100 that provides the actual formant data in the form of a first envelope EDm of a frequency spectrum of the singing voice. The sequencer section further includes the second envelope generator 300 that provides the reference formant data in the form of a second envelope EDr of a frequency spectrum of the model voice. The comparing section includes the comparator or subtractor 410 that differentially processing the first envelope EDm and the second envelope EDr with each other to detect an envelope difference EDd therebetween. The modifying section comprises the equalizer 500 that modifies the frequency characteristics of the collected singing voice MD based on the detected envelope difference EDd so as to equalize the frequency characteristics of the collected singing voice to those of the model voice.

In the first embodiment shown in FIG. 1, the sequencer section comprises a memory in the form of HDD 6 that stores a time-sequential pattern of the reference formant data provisionally sampled from a model singing sound of the model voice, and the sequencer 200 that retrieves the time-sequential pattern of the reference formant data from the memory in synchronization with the progression of the singing voice.

The following describes a constitution of the karaoke apparatus practiced as a second preferred embodiment of the present invention. First, an overall constitution of the second embodiment is generally the same as that of the first embodiment of FIG. 1 except that the formant data FD are replaced with reference formant data elements FD1 through FD5. These reference formant data elements FD1 through FD5 indicate the formants corresponding to vowels "A", "I", "U", "E" and "O". Like the above-mentioned formant data FD, each of elements FD1–FD5 is composed of data indicating the formant frequencies and the formant levels of the first through fifth formants of FIG. 2. For a set of the reference formant data elements FD1 through FD5, a variety of types such as vocalization of an original singer and standard vocalization are prepared.

Figure 13:
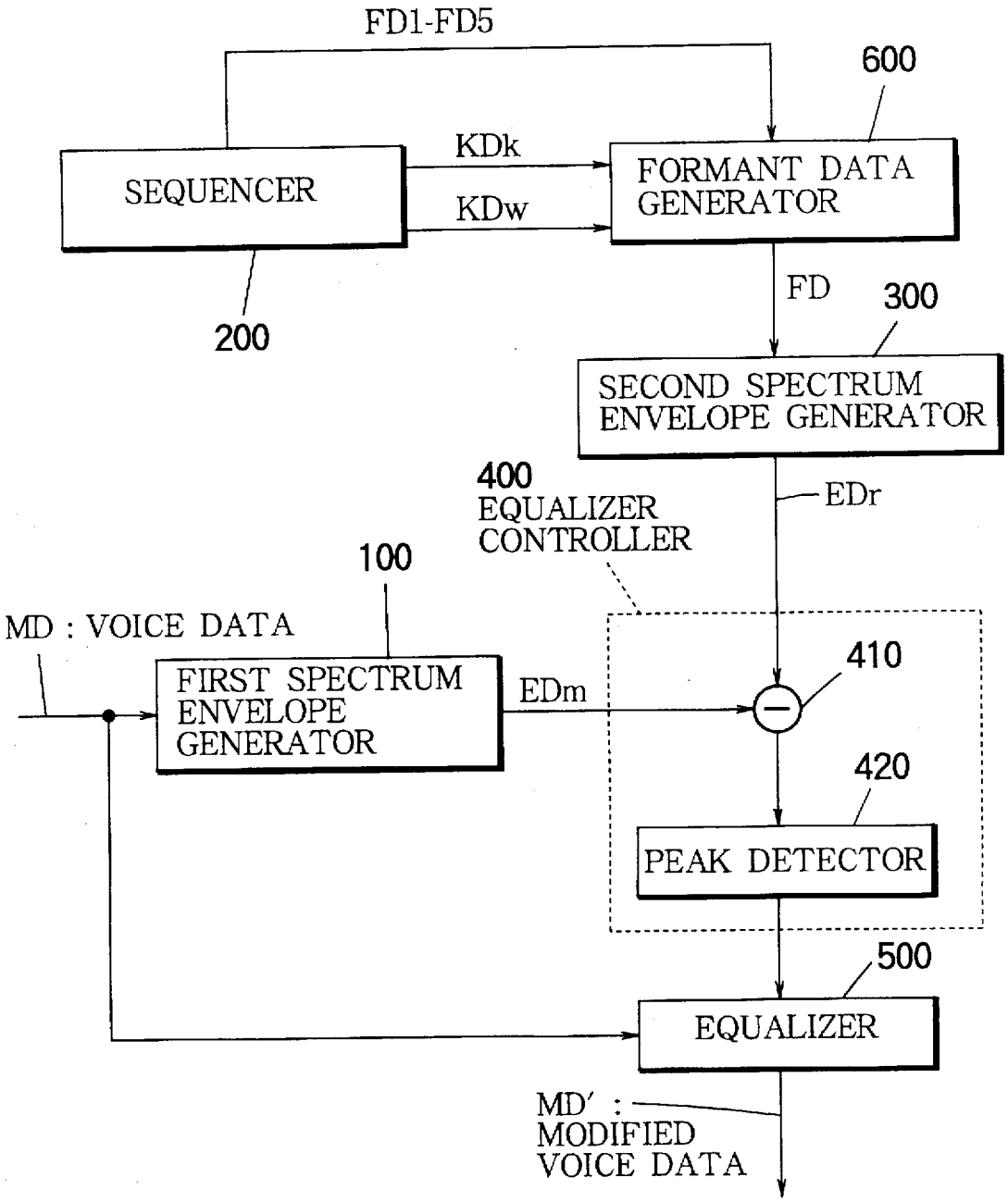
FIG. 13 is a diagram illustrating functional blocks of a CPU associated with a second preferred embodiment of the present invention.

The following describes a functional constitution of the CPU 1 associated with the formant conversion processing with reference to the second embodiment. FIG. 13 shows functional blocks of the CPU 1 associated with the second embodiment. With reference to FIG. 13, components similar to those previously described in FIG. 8 are denoted by the same reference numerals. Now, referring to FIG. 13, the functional blocks of the CPU 1 associated with the second embodiment are generally the same as those of the first embodiment except for a sequencer 200 and a formant data generator 600, so that the description of the other components will be omitted. In FIG. 13, the sequencer 200 sequentially retrieves the reference formant data elements FD1 through FD5, the lyrics word data KDk, and the wipe sequence data KDw from the RAM 2. Based on these retrieved data, the formant data generator 600 generates the reference formant data FD.

Figure 14:
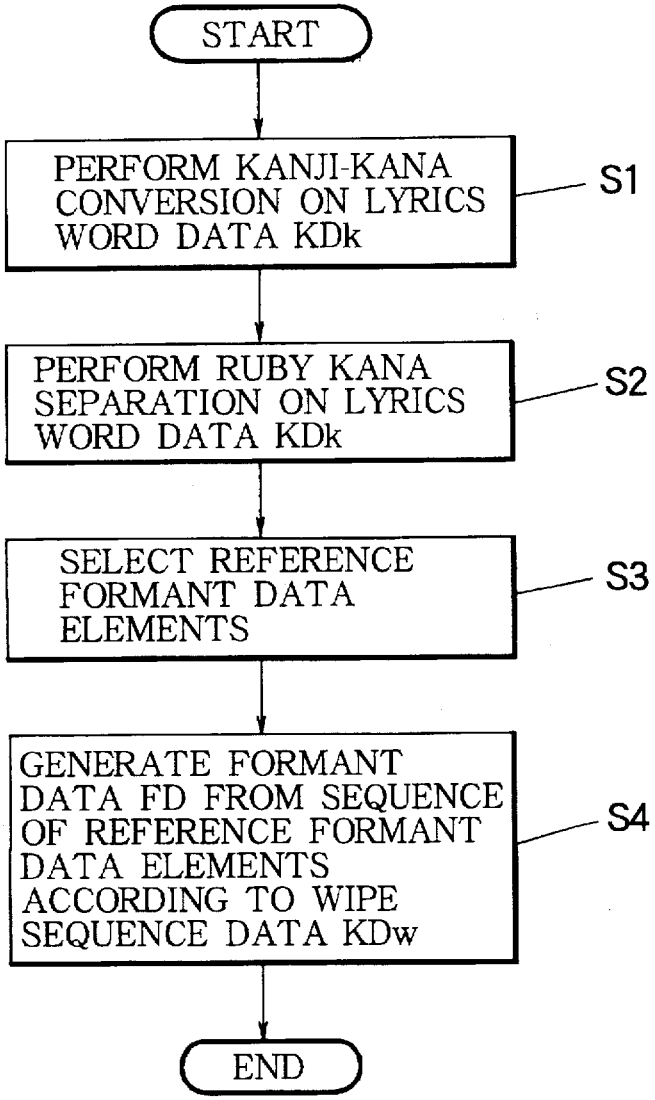
FIG. 14 is a flowchart describing operations of a formant data generator.

In what follows, operations of the formant data generator 600 will be described with reference to a flowchart of FIG. 14. First, in step S1, kanji-to-kana conversion processing is performed on the lyrics word data KDk. For example, the lyrics word data indicate a caption "KOI NO KISETSU" for example in kanji, Chinese characters that the Japanese borrowed from the Chinese. Then, this kanji representation is converted into "KO I NO KI SE TSU" in hiragana, the cursive Japanese syllabic writing system. Then, ruby-kana separation is performed on the data obtained in step S1 to generate a sequence of phoneme data KK that indicate the kana representation of the lyrics (step S2).

Then, vowel components in the phoneme data KK are extracted to generate a reference formant data string (step S3). The reference formant data string is arranged as a sequence of the reference formant data elements FD1 through FD5. For example, if the phoneme data KK indicate a sequence of phonemes "KO I NO KI SE TSU," the phoneme data KK contain vowel components "O", "I", "O", "I", "E", and "U", so that the reference formant data string contains FD5, FD2, FD5, FD2, FD4, and FD3 in the order Meanwhile, the wipe sequence data KDw are used for changing colors of characters of the lyrics as the music goes by. Namely, the wipe sequence data indicate the progression of the lyrics to be sung. Therefore, in step S4, according to the lyrics progression indicated by the wipe sequence data KDw, the reference formant data composed of the string of the reference formant data elements are output sequentially to generate the final formant data FD.

Thus, the formant data generator 600 extracts the vowel components contained in the phonemes of the lyrics, then generates the string of the reference formant data elements FD1 through FD5 corresponding to the extracted vowel components, and applies the lyrics progression information indicated by the wipe sequence data KDw to the generated data string to provide the formant data FD that indicate the time-dependent change of the formants of the model voice.

When the formant data FD generated by the formant data generator 600 are fed to the second spectrum envelope generator 300 of FIG. 13, reference envelope data EDr are generated. The reference envelope data EDr indicate the formant of the model singing voice (for example, the formant of an original singer). When the data EDr are fed to the equalizer controller 400, the same generates differential envelope data EDd that indicate a difference in formant between the singing voice uttered by the karaoke singer and the model voice uttered by the original singer. In the present example, the equalizer 500 is controlled by the peak frequency and peak level of the differential envelope data EDd, so that the adjusted voice data MD' compensated in frequency characteristics by the equalizer 500 approximates the formant of the model singing voice. Consequently, the initial singing voice of the karaoke singer is reproduced based on the adjusted voice data MD', thereby converting the voice quality of the karaoke singer to that of the original singer.

Thus, according to the second preferred embodiment, the vowel changes in the singing voice are detected based on the lyrics word data KDk and the wipe sequence data KDw. Based on the detected vowel changes, the reference formant data elements FD1 through FD5 are selected appropriately to generate the dynamic formant data FD, thereby significantly reducing a quantity of the data associated with the formant conversion processing. In the karaoke apparatus according to the second embodiment, the sequencer section comprises a memory in the form of the HDD 6 that stores a set of formant data elements FD1–FD5 provisionally sampled from vowel components of the model voice, and the formant data generator 600 that sequentially retrieves the formant data elements FD1–FD5 in correspondence to vowel components contained in the singing voice so as to form the reference formant data EDr in synchronization with the progression of the karaoke music. In detail, the HDD 6 further stores the karaoke data containing lyric word data KDk which indicates a sequence of phonemes to be voiced by the karaoke player to create the singing voice and containing sequence data KDw which indicates timings at which each of the phonemes is to be voiced. The formant data generator 600 analyzes the lyric word data KDk and the sequence data KDw to identify each of the vowel components contained in the singing voice so that the formant data generator 600 can retrieve the formant data element FD1–FD5 corresponding to the identified vowel component.

Figure 15:
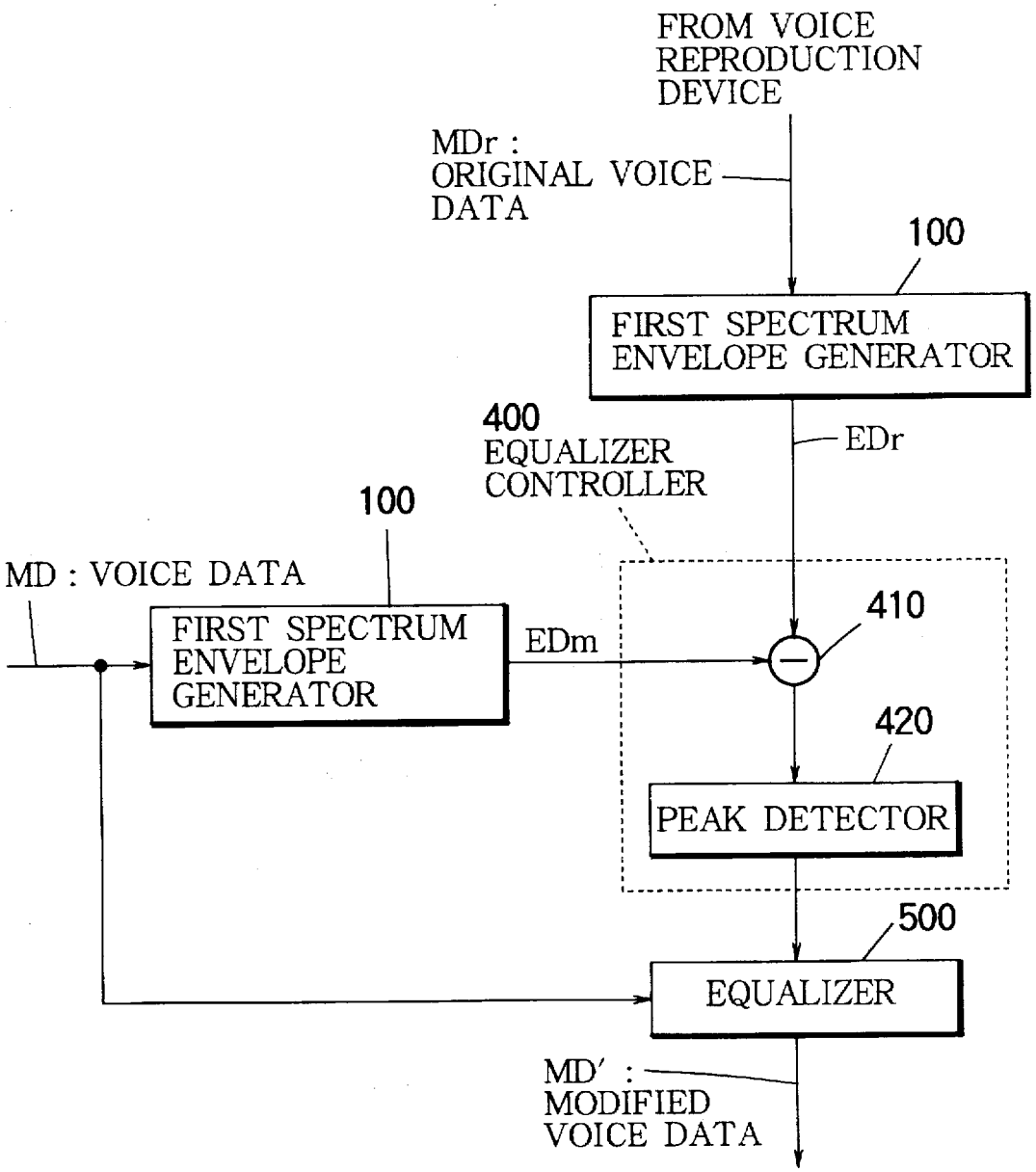
FIG. 15 is a diagram illustrating functional blocks of a CPU associated with a third preferred embodiment of the present invention.

The following describes a constitution of the karaoke apparatus practiced as a third preferred embodiment of the present invention. As shown in FIG. 15, an overall constitution of the third embodiment is generally the same as that of the karaoke apparatus practiced as the first preferred embodiment shown in FIG. 1 except that a voice reproduction device is used. The voice reproduction device is connected to the CPU bus. Under control of the CPU 1, the device drives a recording medium such as a CD (Compact Disc) to reproduce model voice data MDr. The model voice data MDr indicate the singing voice of an original singer, for example. Namely, in this example, the model voice data MDr are used for creating the reference formant data FD. Therefore, no reference formant data FD are distributed from the host computer 4.

The following describes a functional constitution of the CPU 1 associated with the formant conversion processing of the third embodiment. FIG. 15 shows the functional blocks of the CPU 1 associated with the third embodiment. FIG. 15 differs from FIG. 8 in that the first spectrum envelope generator 100 is used in place of the sequencer 200 and the second spectrum envelope generator 300. The first spectrum envelope generator 100 generates the reference envelope data EDr based on the model voice data MDr in a similar manner that the voice envelope data EDm are generated from the singing voice data MD. Then, based on the voice envelope data EDm and the reference envelope data EDr, the equalizer controller 400 generates equalizer control data to vary the frequency characteristics of the equalizer 500. Consequently, the adjusted voice data MD' compensated in frequency characteristics by the equalizer 500 approximate the formant of the model singing voice, thereby altering the voice quality of the karaoke singer.

As described, the third embodiment generates a reference formant directly from a model singing voice, and compares the generated formant with that of the karaoke singer, thereby minimizing a subtle difference between the two formants. According to the third preferred embodiment, the sequencer section comprises a memory such as CD that provisionally records a model singing sound of the model voice, and the envelope generator 100 that sequentially processes the recorded model singing sound to extract therefrom the reference formant data. The karaoke apparatus further comprises a requesting section in the form of the remote commander 7 or the switch panel 10 that requests a desired one of the karaoke music which is originally sung by a professional singer so that the sequencer section provides the reference formant data which indicates a specific vocal quality of the model voice of the professional singer.

The present invention is not restricted to the above-mentioned embodiments. Variations that follow may also be provided by way of example.

(1) In the second embodiment, the formant data generator 600 generates the formant data FD based on the reference formant data elements FD1 through FD5, the lyrics word data KDk, and the wipe sequence data KDw. It will be apparent that the formant data FD can be generated by considering pitch data contained in the play data KDe as a melody part.

(2) In the first and second embodiments, complete formant data FD and a set of the formant data elements FD1 through FD5 may exist together. In such a case, if the complete formant data FD and the set of formant data elements FD1 through FD5 are available at the same time for a piece of music specified by a karaoke singer, the complete formant data FD may precedes.

(3) In the second embodiment, sets of formant data elements FD1 through FD5 may be stored corresponding to singer names. Also, singer name data indicating singer names may be written in the music data KD in advance. When a karaoke player specifies a piece of music, the singer name data in the music data KD corresponding to the specified piece of music are referenced and the corresponding set of the formant data elements FD1 to FD5 are retrieved.

(4) In the first and second embodiments, the reference formant data FD or the reference formant data elements FD1 through FD5 are constituted by pairs of the formant frequency and the formant level. It will be apparent that these formant data may be constituted by pairs of a frequency and a level corresponding to not only the peak but also the dip in the frequency spectrum envelope of the model singing voice. In this case, feasibility of the reference formant can be enhanced.

As described, according to the invention, the input voice formant is dynamically adjusted in respect of voice frequency characteristics such that the input voice formant is matched with the reference voice formant, thereby altering the quality of the singing voice of a karaoke singer. In addition, time-dependent change in the formant data can be detected from the lyrics word data and the wipe sequence data, thereby eliminating necessity for storing the complete formant data beforehand. While the preferred embodiments of the present invention have been described using specific terms, such description is for illustrative purposes only, and it is to be understood that changes and variations may be made without departing from the spirit or scope of the appended claims.

What is claimed is:

1. A voice modifying apparatus for modifying a singing voice to emulate a model voice, comprising:

an input section that collects the singing voice created by a singer;

an analyzing section that sequentially analyzes the collected singing voice to extract therefrom actual formant data representing resonance characteristics of a singer's own vocal organ which is physically activated to create the singing voice;

a sequencer section that operates in synchronization with progression of the singing voice for sequentially providing reference formant data which indicates a vocal quality of the model voice and which is arranged to match with the progression of the singing voice;

a comparing section that sequentially compares the actual formant data and the reference formant data with each other to detect a difference therebetween during the progression of the singing voice; and a modifying section that modifies frequency characteristics of the collected singing voice according to the detected difference so as to emulate the vocal quality of the model voice.

2. A voice modifying apparatus according to claim 1, wherein the sequencer section comprises a memory that stores a time-sequential pattern of the reference formant data provisionally sampled from a model singing sound of the model voice, and a sequencer that retrieves the time-sequential pattern of the reference formant data from the memory in synchronization with the progression of the singing voice.

3. A voice modifying apparatus according to claim 1, wherein the sequencer section comprises a memory that stores a set of formant data elements provisionally sampled from vowel components of the model voice, and a sequencer that sequentially retrieves the formant data elements from the memory in correspondence to vowel components contained in the singing voice so as to form the reference formant data in synchronization with the progression of the singing voice.

4. A voice modifying apparatus according to claim 3, wherein the memory further stores word data which indicates a sequence of phonemes to be voiced by the singer to create the singing voice and sequence data which indicates timings at which each of the phonemes is to be voiced, and wherein the sequencer analyzes the word data and the sequence data to identify each of the vowel components contained in the singing voice so that the sequencer can retrieve the formant data element corresponding to the identified vowel component.

5. A voice modifying apparatus according to claim 1, wherein the sequencer section comprises a memory that provisionally records a model singing sound of the model voice, and a sequencer that sequentially processes the recorded model singing sound to extract therefrom the reference formant data.

6. A voice modifying apparatus according to claim 1, wherein the analyzing section includes an envelope generator that provides the actual formant data in the form of a first envelope of a frequency spectrum of the singing voice, the sequencer section includes another envelope generator that provides the reference formant data in the form of a second envelope of a frequency spectrum of the model voice, the comparing section includes a comparator that differentially processing the first envelope and the second envelope with each other to detect an envelope difference therebetween, and the modifying section comprises an equalizer that modifies the frequency characteristics of the collected singing voice based on the detected envelope difference so as to equalize the frequency characteristics of the collected singing voice to those of the model voice.

7. A karaoke apparatus for producing a karaoke music to accompany a singing voice while modifying the singing voice to emulate a model voice, comprising:

a tone generating section that generates the karaoke music according to karaoke data;

an input section that collects the singing voice created by a karaoke player along with the karaoke music;

an analyzing section that sequentially analyzes the collected singing voice to extract therefrom actual formant data representing resonance characteristics of a karaoke player's own vocal organ which is physically activated to create the singing voice;

a sequencer section that operates in synchronization with progression of the karaoke music for sequentially providing reference formant data which indicates a vocal quality of the model voice and which is arranged according to the karaoke data in matching with the progression of the singing voice;

a comparing section that sequentially compares the actual formant data and the reference formant data with each other to detect a difference therebetween;

a modifying section that modifies frequency characteristics of the collected singing voice according to the detected difference so as to emulate the vocal quality of the model voice; and a mixer section that mixes the modified singing voice to the generated karaoke music in real time basis.

8. A karaoke apparatus according to claim 7, wherein the sequencer section comprises a memory that stores a set of formant data elements provisionally sampled from vowel components of the model voice, and a sequencer that sequentially retrieves the formant data elements from the memory in correspondence to vowel components contained in the singing voice so as to form the reference formant data in synchronization with the progression of the karaoke music.

9. A karaoke apparatus according to claim 8, wherein the memory further stores the karaoke data containing lyric word data which indicates a sequence of phonemes to be voiced by the karaoke player to create the singing voice and containing sequence data which indicates timings at which each of the phonemes is to be voiced, and wherein the sequencer analyzes the lyric word data and the sequence data to identify each of the vowel components contained in the singing voice so that the sequencer can retrieve the formant data element corresponding to the identified vowel component.

10. A karaoke apparatus according to claim 7, further comprising a requesting section that requests a desired one of the karaoke music which is originally sung by a professional singer so that the sequencer section provides the reference formant data which indicates a specific vocal quality of the model voice of the professional singer.

11. A method for modifying a singing voice to emulate a model voice, comprising the steps of:

collecting the singing voice created by a singer;

sequentially analyzing the collected singing voice to extract therefrom actual formant data representing resonance characteristics of a singer's own vocal organ which is physically activated to create the singing voice;

sequentially providing in synchronization with progression of the singing voice reference formant data which indicates a vocal quality of the model voice and which is arranged to match with the progression of the singing voice;

sequentially comparing the actual formant data and the reference formant data with each other to detect a difference therebetween during the progression of the singing voice; and modifying frequency characteristics of the collected singing voice according to the detected difference so as to emulate the vocal quality of the model voice.

12. The method according to claim 11, wherein the step of sequentially providing comprises supplying a memory with a time-sequential pattern of the reference formant data provisionally sampled from a model singing sound of the model voice, and retrieving the time-sequential pattern of the reference formant data from the memory in synchronization with the progression of the singing voice.

13. The method according to claim 11, wherein the step of sequentially providing comprises supplying a memory with a set of formant data elements provisionally sampled from vowel components of the model voice, and sequentially retrieving the formant data elements from the memory in correspondence to vowel components contained in the singing voice so as to form the reference formant data in synchronization with the progression of the singing voice.

14. The method according to claim 13, wherein the step of supplying further comprises supplying the memory with word data which indicates a sequence of phonemes to be voiced by the singer to create the singing voice and sequence data which indicates timings at which each of the phonemes is to be voiced, and the step of retrieving further comprises analyzing the word data and the sequence data to identify each of the vowel components contained in the singing voice so as to retrieve the formant data element corresponding to the identified vowel component.

15. The method according to claim 11, wherein the step of sequentially providing comprises recording a model singing sound of the model voice in a memory, and sequentially processing the recorded model singing sound to extract therefrom the reference formant data.

16. The method according to claim 11, wherein the step of sequentially analyzing comprises providing the actual formant data in the form of a first envelope of a frequency spectrum of the singing voice, the step of sequentially providing comprises providing the reference formant data in the form of a second envelope of a frequency spectrum of the model voice, the step of sequentially comparing comprises differentially processing the first envelope and the second envelope with each other to detect an envelope difference therebetween, and the step of modifying comprises modifying the frequency characteristics of the collected singing voice based on the detected envelope difference so as to equalize the frequency characteristics of the collected singing voice to those of the model voice.

17. A method for producing a karaoke music to accompany a singing voice while modifying the singing voice to emulate a model voice, comprising the steps of:

generating the karaoke music according to karaoke data; collecting the singing voice created by a karaoke player along with the karaoke music;

sequentially analyzing the collected singing voice to extract therefrom actual formant data representing resonance characteristics of a karaoke player's own vocal organ which is physically activated to create the singing voice; sequentially providing in synchronization with progression of the karaoke music reference formant data which indicates a vocal quality of the model voice and which is arranged according to the karaoke data in matching with the progression of the singing voice;

sequentially comparing the actual formant data and the reference formant data with each other to detect a difference therebetween;

modifying frequency characteristics of the collected singing voice according to the detected difference so as to emulate the vocal quality of the model voice; and mixing the modified singing voice to the generated karaoke music in real time basis.

18. The method according to claim 17, wherein the step of sequentially providing comprises supplying a memory with a set of formant data elements provisionally sampled from vowel components of the model voice, and sequentially retrieving the formant data elements from the memory in correspondence to vowel components contained in the singing voice so as to form the reference formant data in synchronization with the progression of the karaoke music.

19. The method according to claim 18, wherein the step of supplying further comprises supplying the memory with the karaoke data containing lyric word data which indicates a sequence of phonemes to be voiced by the karaoke player to create the singing voice and containing sequence data which indicates timings at which each of the phonemes is to be voiced, and wherein the step of sequentially retrieving comprises analyzing the lyric word data and the sequence data to identify each of the vowel components contained in the singing voice to thereby retrieve the formant data element corresponding to the identified vowel component.

20. The method according to claim 17, further comprising the step of requesting a desired one of the karaoke music which is originally sung by a professional singer so that the step of sequentially providing provides the reference formant data which indicates a specific vocal quality of the model voice of the professional singer.

* * * * *